US006313417B1

(12) United States Patent
Schnell

(10) Patent No.: US 6,313,417 B1
(45) Date of Patent: Nov. 6, 2001

(54) CONDUCTING LIQUID TILT SWITCH USING WEIGHTED BALL

(75) Inventor: Robert J. Schnell, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/679,459

(22) Filed: Oct. 4, 2000

(51) Int. Cl.[7] ..... H01H 35/02

(52) U.S. Cl. ..... 200/61.47; 200/220

(58) Field of Search ..... 200/61.45 R, 61.47, 200/61.48, 61.51, 61.52, 182, 193, 194, 214–216, 220, 226, 231, 233, 190; 73/514.03, 514.05, 514.06, 514.09, 521; 302/118

(56) References Cited

U.S. PATENT DOCUMENTS

| | | | | |
|---|---|---|---|---|
| 3,462,573 | * | 8/1969 | Rabinowitz et al. | 200/152 |
| 3,836,739 | * | 9/1974 | Endo | 200/61.47 |
| 4,099,040 | * | 7/1978 | Bitko | 200/220 |
| 4,917,135 | * | 4/1990 | Duncan | 137/2 |
| 5,136,127 | | 8/1992 | Blair | 200/61.52 |
| 5,209,343 | | 5/1993 | Romano et al. | 200/61.52 |
| 5,391,846 | | 2/1995 | Taylor et al. | 200/233 |
| 5,478,978 | | 12/1995 | Taylor et al. | 200/233 |
| 5,508,003 | | 4/1996 | Rancourt et al. | 420/555 |
| 5,543,767 | | 8/1996 | Elenbas | 335/205 |
| 5,751,074 | | 5/1998 | Prior et al. | 307/118 |
| 5,792,236 | | 8/1998 | Taylor et al. | 75/715 |

* cited by examiner

*Primary Examiner*—Michael Friedhofer
(74) *Attorney, Agent, or Firm*—John G. Shudy, Jr.

(57) ABSTRACT

Electronic tilt switches utilizing an environmentally safe electrically conductive, non-mercury fluid and a spherical weight, in which the switches have similar performance to mercury switches. The switch also avoids common problems resulting from conductive fluids having different densities and viscosities than mercury, as well as avoiding the problems of conventional tilt switches using solely conductive spheres to actuate the switch.

23 Claims, 3 Drawing Sheets

CONDUCTING LIQUID TILT SWITCH USING WEIGHTED BALL

BACKGROUND OF THE INVENTION

1. Field of the Invention

The invention relates to environmentally safe, non-mercury electronic switches. More particularly, the invention pertains to electronic tilt switches utilizing a spherical weight and an environmentally safe electrically conductive, non-mercury fluid having similar performance to mercury switches.

2. Description of the Related Art

The present invention relates to electronic devices that are alternately electrically turned "on" and "off" based on the position of a housing containing a conductive fluid and a spherical weight. This type of device is generally known in the art as a "tilt switch". A typical tilt switch comprises a hollow, enclosed housing or capsule having electrodes within the housing and extending through and outside the housing. Conventionally, a conductive material either in the form of a fluid, a weight or both is placed within the hollow housing. When using a fluid conductor, the housing is aligned in an "on" position when the conductive fluid electrically connects each of the electrodes, allowing the flow of electricity. The housing is aligned in an "off" position when the conductive fluid in the housing does not electrically connect the electrodes, preventing the flow of electricity.

Traditionally, liquid mercury has been the preferred conductive material because it remains fluid at a wide range of temperatures, including room temperature. Also, mercury has been desirable because it has high surface tension, does not wet many surfaces that it contacts, and generally does not become damaged by contact with the electrodes. However, mercury, its vapor and its oxidized products are extremely toxic. Exposure to mercury has been known to cause disorders such as psychiatric problems in humans and disruption the endocrine systems of humans and animals. This has created a need in the art for a non-toxic alternative.

Commonly employed alternatives to toxic mercury switches have been to replace the toxic mercury such as with conductive spheres or environmentally safe fluids. For example, U.S. Pat. No. 5,136,127 teaches a tilt switch having at least one free moving conductive sphere positioned in a housing that moves to an operating position when the weight is biased by gravity by inclination of the housing. However, conductive metal spheres have certain disadvantages. For example, conductive spheres are especially vulnerable to surface damage caused by electrical arcing which commonly occurs when electrical current is made or broken by the spherical conductor moving into contact or out of contact with electrodes. This arcing can create pitting on the surface of the sphere that may corrode the sphere and interfere with the smooth rolling of the sphere during later cycles of its operation.

U.S. Pat. No. 5,751,074 provides a switch having a conductive fluid filing a first portion of a housing and a non-conductive medium filling a second portion of the housing and where gravity or inertial force causes the conductive fluid to move within the housing and electrically connect and disconnect at least two electrodes. However, conventionally used conductive fluids have certain disadvantages. For example, substitute fluids generally do not shift the weight of the housing as mercury does. This frequently causes a liquid switch to rapidly vacillate between the "on" and "off" positions within the housing, causing the electrodes to "sizzle". Also, substitute conductive fluids typically have vastly different densities and viscosities than mercury. This creates problems if conductive fluids do not flow in a housing as a single mass as mercury does. Rather, thin liquids slosh around in the housing or thick liquids slowly ooze within the housing.

The present invention offers a solution to the disadvantages of the related art. The present invention provides a tiltable electrical device comprising a closed housing having at least two electrodes extending from inside, through and outside the housing, an electrically conductive fluid within the housing, said fluid being moveable within the housing in response to a change in attitude of the housing, between a first position wherein said fluid is in electrical contact with at least two electrodes, and a second position wherein said fluid is not in electrical contact with at least two electrodes, and at least one spherical weight inside the housing, said weight being moveable within the housing in response to a change in attitude of the housing, between said first position and said second position. This device is an efficient and non-toxic replacement for conventional mercury switches. Further, the invention provides a process that requires no complex manufacturing steps and is a less expensive alternative than switches of the prior art. The weighted ball functions to transfer the balance of the weight of the housing, causing the conductive fluid to move between the first and second positions and thereby cause the fluid to alternately electrically contact or disengage from the electrodes.

SUMMARY OF THE INVENTION

The invention provides an electrical device comprising:

a) a closed, hollow housing having at least one electrode extending from inside, through and outside the housing;

b) an electrically conductive fluid within the housing, said fluid being moveable within the housing in response to a change in attitude of the housing, between a first position wherein said fluid is in electrical contact with at least two electrodes, and a second position wherein said fluid is not in electrical contact with at least two electrodes; and c) at least one spherical weight inside the housing, said weight being moveable within the housing in response to a change in attitude of the housing, between said first position and said second position.

The invention also provides an electrical circuit comprising an electrically conductive pathway connected to an electrical device, which device comprises:

a) a closed, hollow housing having at least one electrode extending from inside, through and outside the housing;

b) an electrically conductive fluid within the housing, said fluid being moveable within the housing in response to a change in attitude of the housing, between a first position wherein said fluid is in electrical contact with at least two electrodes, and a second position wherein said fluid is not in electrical contact with at least two electrodes;

c) at least one spherical weight inside the housing, said weight being moveable within the housing in response to a change in attitude of the housing, between said first position and said second position; and d) a pivot for orienting the attitude of the housing and causing the spherical weight to move between said first and second positions and causing the conductive fluid to alternately electrically contact and electrically non-contact at least two electrodes;

wherein the electrically conductive pathway is electrically connected to at least one of said electrodes.

The invention further provides a process for producing an electrical device comprising:

a) placing an electrically conductive fluid and a spherical weight into a hollow housing, said housing having at least one electrode extending from inside, through and outside the housing, said fluid and spherical weight being moveable within said housing in response to a change in attitude of said housing, between a first position wherein said fluid is in electrical contact with at least two electrodes, and a second position wherein said fluid is not in electrical contact with at least two electrodes; and b) sealing the housing.

DETAILED DESCRIPTION OF THE PREFERRED EMBODIMENTS

The present invention relates to electronic devices that are alternately electrically turned "on" and "off" based on the position of an electrically conductive fluid and spherical weight inside an enclosed housing. The electronic devices provided by the invention retain the high performance of mercury based switches but are also environmentally safe and non-toxic as opposed to mercury based switches.

Figure 2:
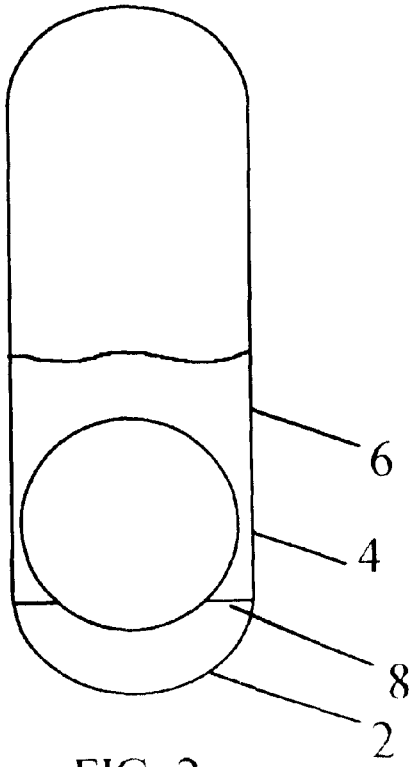
FIG. 2 is a schematic representation of a device having a plurality of electrodes extending into a housing and having an electrically conductive fluid and spherical weight inside it and where the housing is aligned so that the fluid is in electrical contact with the electrodes. This device is in the "on position".
Figure 3:
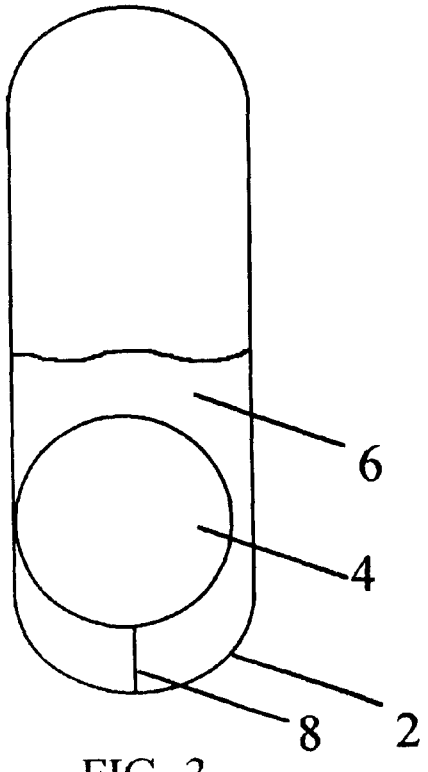
FIG. 3 is a schematic representation of a device wherein the housing is an electrode and a single electrode extends into the housing and having an electrically conductive fluid and a spherical weight inside the housing and where the device is in the "on position".

At least one spherical weight 4 and a conductive fluid 6 are placed inside a hollow housing 2 having at least one electrode 8 extending from inside, through and outside the housing the housing 2. This can be seen in the figures. In a preferred embodiment, only one electrode 8 physically extends inside the housing, while the housing itself comprises an electrode, allowing for the completion of a circuit. This embodiment can be seen in FIG. 3. In another preferred embodiment, a plurality of electrodes 8 physically extend inside the housing 2, irrespective of whether or not the housing comprises an electrode. This embodiment can be seen in FIG. 2.

The housing 2 is generally elongate and preferably is cylindrically-shaped. The housing 2 comprises a hollow tube which is generally made of either plastic, ceramic material or glass. In another embodiment where the housing itself comprises an electrode, the housing is preferably made of a conductive material, such as ferrous steel. The housing may also be made of a non-magnetic, electrically conductive material, such as copper, brass, aluminum or stainless steel when actuation of the device of the invention is to be conducted by magnetic flux.

The housing 2 is formed using well known techniques, such as with progressive dies or by using cylindrical or square stock cuts. The housing 2 is preferably circular in cross-section, but may also be square or rectangular in cross section.

Figure 1:
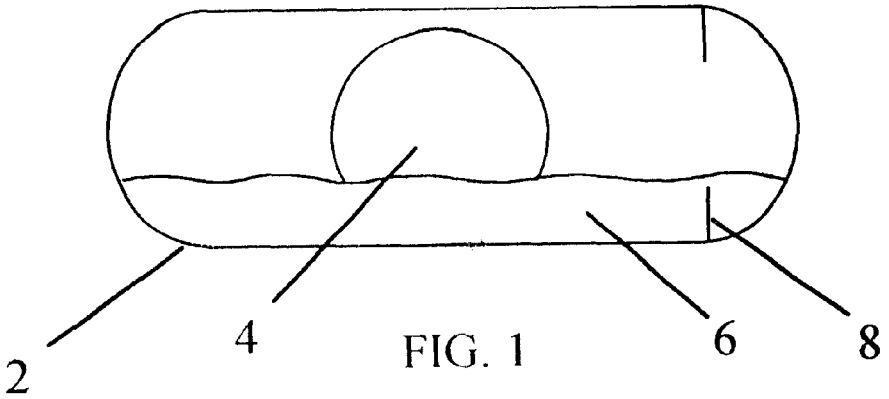
FIG. 1 is a schematic representation of a device having an enclosed, hollow housing having a electrically conductive fluid and spherical weight inside it where the housing is aligned so that the fluid in electrical non-contact with both electrodes. This device is in the "off position".
Figure 4:
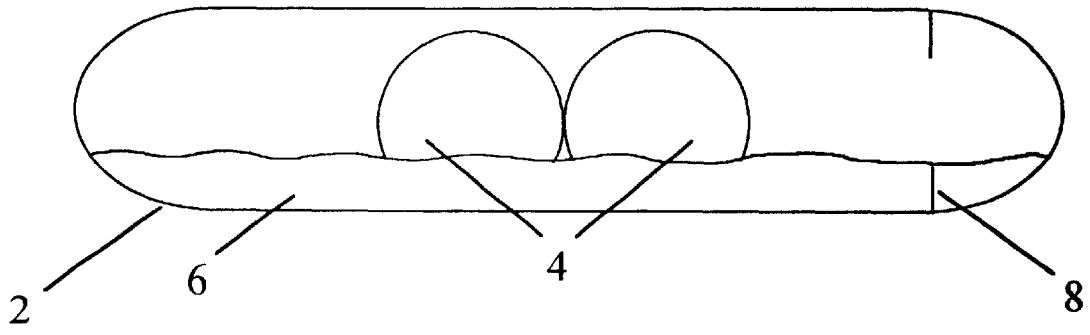
FIG. 4 is a schematic representation of a device having a plurality of spherical weights inside the housing and is set in the "off position".
Figure 5:
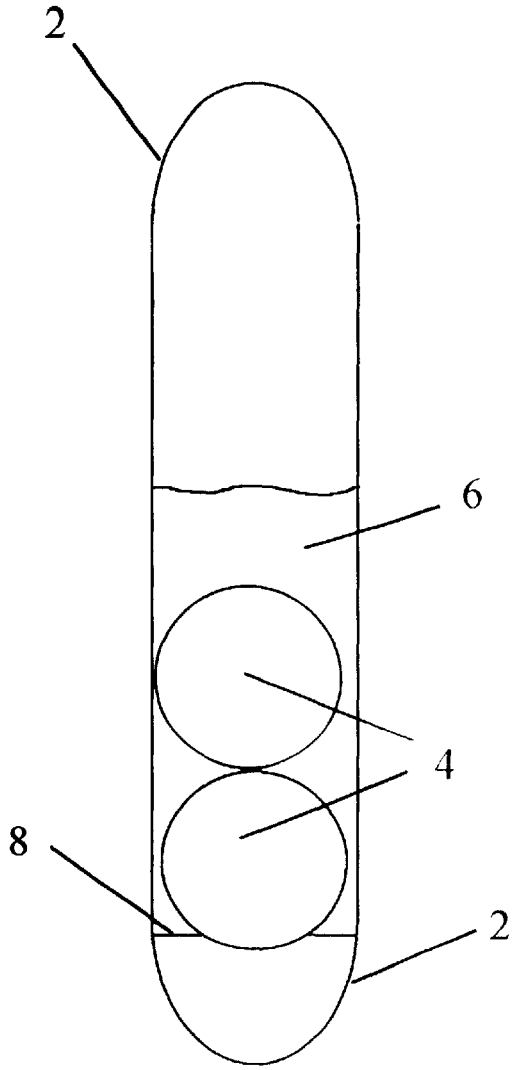
FIG. 5 is a schematic representation of a device having a plurality of spherical weights inside the housing and is set in the "on position".
Figure 6:
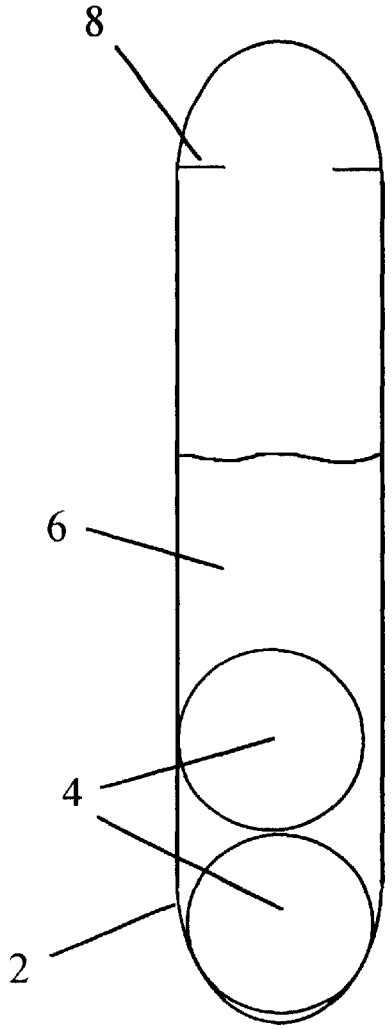
FIG. 6 is a schematic representation of a device having a plurality of spherical weights inside the housing and is set in an alternate "off position".

Partially filling the housing 2 is electrically conductive fluid 6. Electrically conductive fluid 6 is moveable within the housing in response to a change in attitude of the housing, between a first position wherein the fluid 6 is in electrical contact with at least two electrodes, and a second position wherein the fluid 6 is not in electrical contact with at least two electrodes. Examples of the first position can be seen in FIGS. 2, 3 and 5. Examples of the second position can be seen in FIGS. 1, 4 and 6.

Preferred conductive fluids 6 within the scope of this invention include metal and metal alloy fluids, as well as non-metallic fluids. Preferred non-metallic fluids non-exclusively include ionic solutions of sodium chloride, magnesium sulfate, hydrochloric acid, sulfuric acid, or other types of acids, bases or salts. Further, suspended conductive particles may also be included in solution, so long as the particles are well suspended in the solution. Conductive fluid 6 may also comprise water, an aqueous electrolyte solution, a polyethylene glycol aqueous solution, and/or a $C_1$ to $C_7$ straight or branched chain alkane, alkene or aryl alcohol solution, such as methyl alcohol, ethyl alcohol, n-isopropyl alcohol, phenol, toluol. Other conductive fluids 6 include an acetic acid solution, ammonia solution, acetone, $\alpha$-hydroxy acetone, and amino acid solutions. Preferred metal or metal alloy fluids non-mercury metals that remain in the liquid state at room temperature and non-exclusively include gallium, gallium alloys, and gallium-indium-tin alloys.

Sealed inside the housing is at least one spherical weight 4. The spherical weight is capable of moving freely within the housing in response to a change in attitude of the housing, and is moveable within the housing in response to a change in attitude of the housing, between the first and second positions as described above.

The sphere 4 preferably comprises a material that is either an electrical conductor or non-conductor. Preferred conductive materials non-exclusively include metals such as lead, steel, brass, copper, iron, steel, stainless steel and the like. The sphere may further include a plating such as nickel, silver or gold to increase surface conductivity. However, if the device of the invention is to be actuated by a magnetic flux, the spherical weight 4 is made of an electrically conductive magnetic material, such as ferrous steel. Suitable non-conductive materials non-exclusively include glass and ceramics.

The spherical weight 4 may be solid or hollow, but it is preferably solid. Alternately, the sphere 4 may comprise a non-conductive inner portion, such as a polymer, having an outer shell of a conductive metal. The preferred radius of the sphere 4 is of from about 1 mm to about 10 mm. More preferably, the radius of the sphere is of from about 3 mm to about 8 mm. The preferred weight of the sphere is of from about 0.5 g to about 2.0 g. More preferably, the sphere weighs from about 0.5 g to about 1.0 g.

The interior of the housing may optionally be partially filled with an atmosphere that is inert to conductive materials within the housing to protect the housing, conductive fluid, spherical weight and electrodes against corrosion and contamination, resulting in achievement of stable operating characteristics for a long period of time. Suitable inert gases non-exclusively include hydrogen, helium, argon and nitrogen. Alternatively, the housing may be placed under vacuum conditions to achieve similar results. The housing is then sealed using well known techniques.

Figure 7:
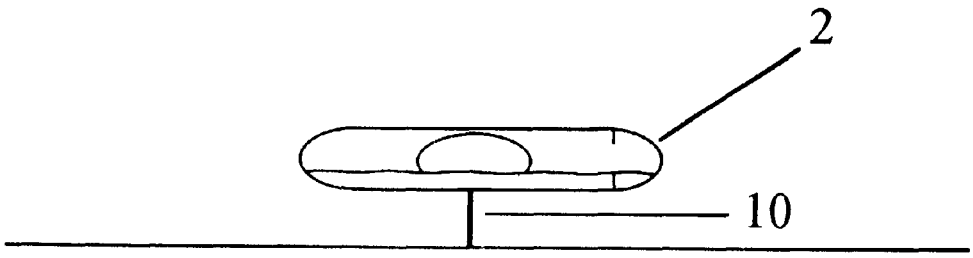
FIG. 7 is a schematic representation of the electronic device of the invention connected to a support via a pivot.
Figure 8:
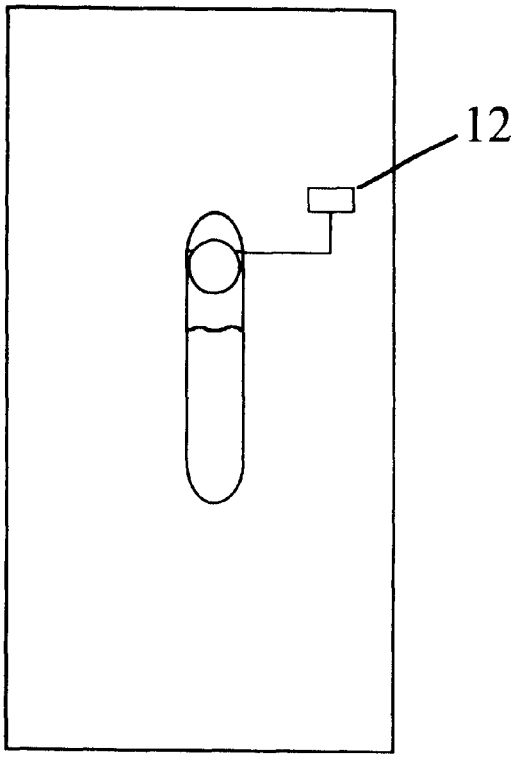
FIG. 8 is an overhead schematic representation of the device of the invention connected to a circuit and in the "on position".
Figure 9:
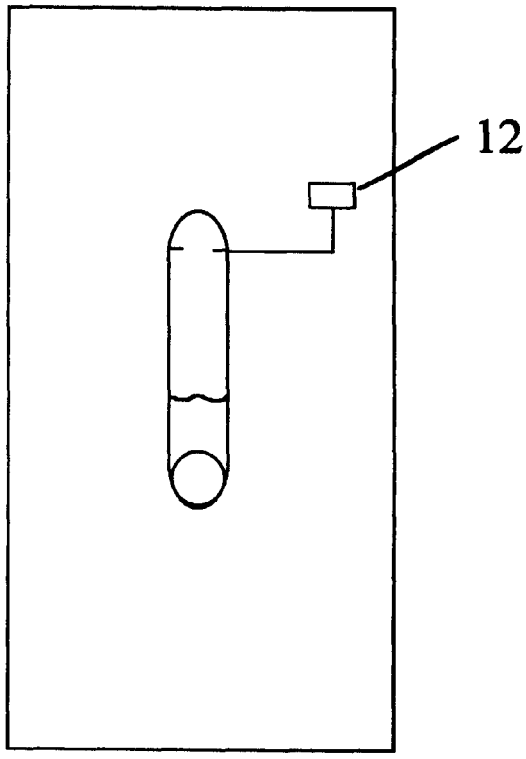
FIG. 9 is an overhead schematic representation of the device of the invention connected to a circuit and in the "off position".

The electrical device of the invention is preferably physically attached to a support as shown in FIG. 7. The device is preferably attached to the support via a pivot 10 along its central vertical axis. The pivot 10 also orients the attitude of the housing 2, causing the conductive fluid 6 and spherical weight 4 to alternately roll from an "off position" as seen in FIG. 9, where the conductive fluid 6 is not contacting the electrodes, to an "on position" as seen in FIG. 8, where the conductive fluid 6 electrically connects at least two electrodes, allowing electricity to flow through the device. As seen in FIGS. 8 and 9, the device may be electrically connected to a circuit 12 or other electrical components through well known techniques such as by soldering or welding, forming an electrically conductive pathway. Attached to the electrical circuit 12 is a power supply (not shown). The circuit may be a member situated in various electronic equipment and systems, enabling the device of the invention to be used in multiple applications.

In use, the electrical device is generally capable of functioning as a tilt switch or a proximity switch. When functioning as a tilt switch, the housing is mechanically tilted using techniques well known in the art, allowing gravity to pull the conductive fluid and sphere toward or away from the electrodes, thereby providing an alternately opened and closed electrical circuit between the fluid 6 and electrodes 8.

When functioning as a proximity switch, the sphere 4 and housing 2 is actuated by a permanent magnet. In this embodiment it is required that the spherical weight be a magnetic metal, such as ferrous steel. By movement of the permanent magnet with respect to the housing, the sphere 4 is selectively drawn toward or away from the electrodes, thereby causing the housing to tilt and the conductive fluid to move between said first and second positions and the switch to function as a proximity switch. Also, an electromagnet wrapped with electric wires is provided adjacent to the housing. An electric current is provided to these wires using techniques that are well known in the are for selectively creating a magnetic flux.

In addition to the device of the present invention, the invention provides a process for producing an electrical device. In sum, the process comprises placing an electrically conductive fluid and spherical weight into a hollow housing and sealing the housing.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. An electrical device comprising:

a) a closed, hollow housing comprising at least two electrodes, wherein at least one of said electrodes extends from inside, through and outside the housing;

b) an electrically conductive fluid within the housing, said fluid being moveable within the housing in response to a change in attitude of the housing, between a first position wherein said fluid is in electrical contact with at least two of said electrodes, and a second position wherein said fluid is not in electrical contact with at least two of said electrodes; and c) at least one spherical weight inside the housing and in contact with the electrically conductive fluid, said weight being moveable within the housing in response to a change in attitude of the housing, between said first position and said second position, wherein the spherical weight is capable of causing the conductive fluid to move between the first and second positions and thereby cause the fluid to alternately electrically contact or disengage from the electrodes.

2. The electrical device of claim 1 wherein the housing comprises one of said electrodes.

3. The electrical device of claim 1 wherein at least two of said electrodes extend from inside, through and outside the housing.

4. The electrical device of claim 1 wherein the electrically conductive fluid comprises a metal or an electrolytic solution.

5. The electrical device of claim 1 wherein the electrically conductive fluid comprises gallium, gallium alloys, gallium-indium-tin alloys, solutions comprising acids, bases, salts, water, aqueous electrolyte solutions, polyethylene glycol aqueous solutions, a $C_1$ to $C_7$ straight or branched chain alkane solution, an alkene solution, an aryl alcohol solution, an ammonia solution, acetone, $\alpha$-hydroxy acetone, an amino acid solution and combinations thereof.

6. The electrical device of claim 1 wherein the spherical weight comprises a material selected from the group consisting of lead, steel, brass, copper, iron, steel, stainless steel, glass, ceramics and combinations thereof.

7. The electrical device of claim 1 further comprising an atmosphere that is inert to conductive materials within the housing.

8. The electrical device of claim 1 wherein the inside of the sealed housing is under vacuum conditions.

9. The electrical device of claim 1 further comprising a pivot for orienting the attitude of the housing and causing the electrically conductive fluid to alternately electrically contact and electrically non-contact at least two of said electrodes.

10. The electrical device of claim 1 wherein the device is connected to a circuit.

11. An electrical circuit comprising the electrical device of claim 1.

12. An electrical circuit comprising an electrically conductive pathway connected to an electrical device, which device comprises:

a) a closed, hollow housing comprising at least two electrodes, wherein at least one of said electrodes extends from inside, through and outside the housing;

b) an electrically conductive fluid within the housing, said fluid being moveable within the housing in response to a change in attitude of the housing, between a first position wherein said fluid is in electrical contact with at least two of said electrodes, and a second position wherein said fluid is not in electrical contact with at least two of said electrodes;

c) at least one spherical weight inside the housing and in contact with the electrically conductive fluid, said weight being moveable within the housing in response to a change in attitude of the housing, between first position and said second position; wherein the spherical weight is capable of causing the conductive fluid to move between the first and second positions and thereby cause the fluid to alternately electrically contact or disengage from the electrodes and d) a pivot for orienting the attitude of the housing and causing the spherical weight to move between said first and second positions and causing the conductive fluid to alternately electrically contact and electrically non-contact at least two of said electrodes; wherein the electrically conductive pathway is electrically connected to at least one of said electrodes.

13. The electrical circuit of claim 12 wherein the housing comprises one of said electrodes.

14. The electrical circuit of claim 12 wherein at least two of said electrodes extend from inside, through and outside the housing.

15. The electrical circuit of claim 12 wherein the electrically conductive fluid comprises a metal or an electrolytic solution.

16. The electrical circuit of claim 12 wherein the electrically conductive fluid comprises gallium, gallium alloys, gallium-indium-tin alloys, solutions comprising acids, bases, salts, water, aqueous electrolyte solutions, polyethylene glycol aqueous solutions, a $C_1$ to $C_7$ straight or branched chain alkane solution, an alkene solution, an aryl alcohol solution, an ammonia solution, acetone, α-hydroxy acetone, an amino acid solution and combinations thereof.

17. The electrical circuit of claim 12 wherein the spherical weight comprises a material selected from the group consisting of lead, steel, brass, copper, iron, steel, stainless steel, glass, ceramics and combinations thereof.

18. The electrical circuit of claim 12 wherein the housing further comprises an atmosphere that is inert to conductive materials.

19. The electrical circuit of claim 12 wherein the inside of the sealed housing is under vacuum conditions.

20. A process for producing an electrical device comprising:

a) placing an electrically conductive fluid and a spherical weight into a hollow housing, said housing comprising at least two electrodes, wherein at least one electrode extends from inside, through and outside the housing, said fluid and spherical weight in contact with each other and being moveable within said housing in response to a change in attitude of said housing, between a first position wherein said fluid is in electrical contact with at least two of said electrodes, and a second position wherein said fluid is not in electrical contact with at least two of said electrodes; wherein the spherical weight is capable of causing the conductive fluid to move between the first and second positions and thereby cause the fluid to alternately electrically contact or disengage from the electrodes; and b) sealing the housing.

21. The process of claim 20 further comprising filling the housing with an inert gas prior to sealing.

22. The process of claim 20 further comprising applying a vacuum to the inside of the housing prior to sealing.

23. The process of claim 20 further comprising attaching the housing to a pivot for orienting the attitude of the housing and causing the electrically conductive fluid to alternately electrically contact and electrically non-contact at least two of said electrodes.

* * * * *